United States Patent [19]

Dydyk

[11] 4,260,962

[45] Apr. 7, 1981

[54] RF TERMINATION FOR COAXIAL TRANSMISSION LINES

[75] Inventor: Michael Dydyk, Scottsdale, Ariz.

[73] Assignee: Motorola, Inc., Schaumburg, Ill.

[21] Appl. No.: 64,457

[22] Filed: Aug. 6, 1979

[51] Int. Cl.[3] ..... H01P 1/26

[52] U.S. Cl. ..... 333/22 R; 338/216

[58] Field of Search ..... 333/22 R, 81 A; 338/216

[56] References Cited

U.S. PATENT DOCUMENTS

| | | | |
|---|---|---|---|
| 2,438,915 | 4/1948 | Hansen | 333/22 R |
| 2,968,774 | 1/1961 | Rodriquez | 333/22 R X |
| 3,846,720 | 11/1974 | Mohr | 333/22 R |

*Primary Examiner*—Paul L. Gensler

*Attorney, Agent, or Firm*—Eugene A. Parsons

[57] ABSTRACT

A step change in the diameter of the inner conductor or the outer conductor of the transmission line with absorptive material having a shoulder abutting against the step change and tapering toward the opposite conductor with the radius of the absorptive material at the step change being sufficient to provide a characteristic impedance substantially equal to the characteristic impedance of the coaxial transmission line prior to the step change.

10 Claims, 7 Drawing Figures

PRIOR ART

RF TERMINATION FOR COAXIAL TRANSMISSION LINES

BACKGROUND OF THE INVENTION

The present invention relates to matched load impedances, or terminations, for coaxial transmission lines. Coaxial transmission lines are utilized in a wide variety of applications, including microwave oscillators, couplers, directional filters, etc. Some typical applications are illustrated in U.S. Pat. No. 4,016,507, issued Apr. 5, 1977, entitled "Solid State Microwave Oscillator Using Coupled TEM Transmission Lines", U.S. Pat. No. 4,034,314, issued July 5, 1977, entitled "Microwave Diode Coaxial Circuit Oscillator Improvement", U.S. Pat. No. 4,143,334, issued Mar. 6, 1979, entitled "Microwave/Millimeterwave Oscillator", and U.S. Pat. No. 4,155,051, issued May 15, 1979, entitled "Harmonically Tuned High Power Voltage Controlled Oscillator". These terminations are formed, generally, from a rubberized absorptive material physically formed with a linear taper to minimize reflection between the source impedance and the low impedance formed when the absorptive material completely fills the space between the inner and outer conductors. The standard approach to realization of such a termination is discussed in conjunction with FIG. 1.

SUMMARY OF THE INVENTION

The present invention pertains to an RF termination for use with a coaxial transmission line wherein one of the inner or outer conductors has a step change therein and absorptive material having a shoulder at one end thereof is positioned in abutting engagement with the step change and formed so as to taper from the shoulder toward the opposite conductor and into engagement therewith, the radius of the absorptive material at the shoulder being sufficient to provide a characteristic impedance at the step change which is substantially equal to the characteristic impedance of the coaxial transmission line prior to the step change.

For high power applications the step change is in the outer conductor where cooling fins can be provided to further increase the power handling capability of the termination.

It is an object of the present invention to provide a new and improved RF termination for use with a coaxial transmission line.

It is a further object of the present invention to provide a new and improved RF termination for use with a coaxial transmission line, which termination is rugged and simpler to fabricate as well as more uniform.

It is a further object of the present invention to provide an RF termination for use with a coaxial transmission line which is smaller (shorter) and may be constructed with higher power handling capabilities.

These and other objects of this invention will become apparent to those skilled in the art upon consideration of the accompanying specification, claims and drawings.

DESCRIPTION OF THE PREFERRED EMBODIMENTS

Figure 1:
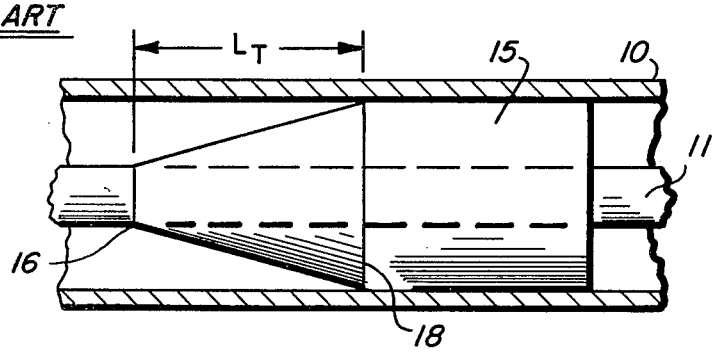
FIG. 1 is a sectional view of a portion of coaxial transmission line having a prior art RF termination therein.

Referring specifically to FIG. 1, a sectional view of a portion of coaxial transmission line including a prior art RF termination is illustrated. The coaxial transmission line has an outer conductor 10 and an inner conductor 11, both having constant radii throughout the length thereof. Absorptive material 15 is positioned in surrounding engagement with the inner conductor 11 and is formed with a linear taper extending a distance $L_T$ from a forward razor edge 16 to an area 18 where the absorptive material 15 completely fills the space between the inner conductor 11 and the outer conductor 10. In this prior art structure the design required $L_T$ to be a minimum of one-half wavelength at the lowest frequency of operation. Generally, the taper is made one-half wavelength long where the wavelength is calculated in air, which makes the taper unnecessarily long. This is done because no equations are available for the partially loaded (with dielectric or absorptive material) coaxial transmission line. A more important disadvantage of the standard prior art design is the requirement of the razor edge 16 at the beginning of the linear taper. The razor edge 16 is a requirement because it is necessary to minimize reflections within the coaxial transmission line. The razor edge 16 is difficult to fabricate, it is easy to break and in general is not uniform. Therefore, rejection rates and fabrication costs are high while reliability and repeatability are low.

Figure 2A:
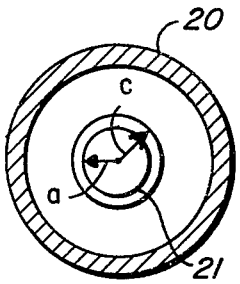
FIG. 2B is a sectional view of a portion of coaxial transmission line including an RF termination embodying the present invention, with FIG. 2A being a left and FIG. 2C being a right end view thereof.
Figure 2B:
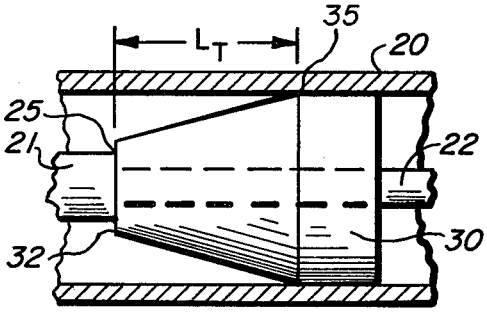
Figure 2C:
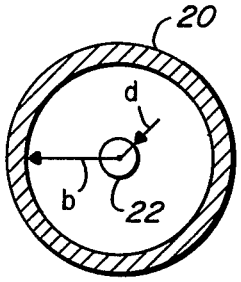

Referring to FIG. 2, a cross-sectional view of a portion of a coaxial transmission line including an RF termination embodying the present invention is illustrated in FIG. 2B while FIGS. 2A and 2C illustrate views of the left and right ends thereof, respectively. In these FIGURES the numeral 20 indicates an outer conductor of the coaxial transmission line while the inner conductor includes a first portion 21 and a second portion 22. The portion 21 of the inner conductor has a radius indicated by the arrow a in FIG. 2A while the second portion 22 has a radius indicated by the arrow d in FIG. 2C. As can be seen, the portion 22 has a substantially smaller radius than the portion 21 and there is a step change or reduction in the radius at 25. Absorptive material 30 is positioned in the coaxial transmission line in symmetrical surrounding engagement with the portion 22 of the inner conductor. The absorptive material 30 is formed with a shoulder 32 at the forward or leading edge thereof in abutting engagement with the step change 25 in the inner conductor. The outer radius of the absorptive material 30 at the shoulder 32 is indicated by the arrow c in FIG. 2A and must be sufficient to provide a characteristic impedance at the step change 25 which is substantially equal to the characteristic impedance of the coaxial transmission line prior to the step change, or at the portion 21 of the inner conductor. It is necessary to form the start of the absorptive material so that the impedance is the same as the portion of the transmission line with the center conductor 21 so that discontinuities are not seen by the electric circuit and reflections and the like are prevented or minimized.

The absorptive material 30 is tapered linearly, in this embodiment, to a point 35 where it engages the outer conductor 20. The distance from the shoulder 32 to the area 35 where the absorptive material engages the outer conductor 20 is designated $L_T$. While only linear tapers are disclosed in this embodiment, other types of tapers could also be realized by those skilled in the art. In order to provide the correct matching impedance at the step change 25 the following formula may be used for calculating the radius, c, of the absorptive material 30 at the shoulder 32.

$$C = d\,\mathrm{Log}_{10}^{-1}\left[\left(\frac{\Sigma_R}{\Sigma_R - 1}\right)\mathrm{Log}_{10}\frac{b}{d}\left[1 - \frac{1}{\left(\frac{138}{Z_o}\mathrm{Log}_{10}\frac{b}{d}\right)^2}\right]\right]$$

where $Z_O$ is the characteristic impedance of the coaxial transmission line prior to the step change at C. To utilize this formula it is necessary to know (usually given and depends on the characteristic impedance of the application) the radius b of the outer conductor 20 and the $\Sigma R$, which is the relative dielectric constant of the absorptive material 30. Also, the radius d for the portion 22 of the inner conductor must be selected. This selection is arbitrary as long as it is physically realizable. Once the radius c of the shoulder 32 has been calculated the length $L_T$ of the taper can be calculated from the following formula.

$$L_T = \frac{\lambda_{min/2}}{1 + \frac{1}{2}\left(\frac{\Sigma_R - 1}{\Sigma_R L_n \frac{b}{d}}\right)\left[2 + L_n\frac{c}{d} + \left(\frac{4}{\frac{b}{c} - 1}\right)\mathrm{Log}_{10}\left(\frac{2}{1 + \frac{b}{c}}\right)\right]}$$

As an example, a termination of the type described above was constructed for a coaxial transmission line with an outer conductor having a radius of 0.125 inches and an inner conductor (before the step change) of 0.054 inches. The minimum frequency selected was 9.267 gigahertz and the absorptive material utilized had an $\Sigma R$ of 25. At the step change the radius of the inner conductor was reduced to 0.040 inches. Utilizing the above listed formula, the outer radius c of the absorptive material at the leading shoulder was calculated as 0.070 inches and the length $L_T$ of the taper was calculated to be 0.360 inches. The termination was constructed in accordance with these dimensions and tested, resulting in excellent performance. A maximum VSWR of 1.5 to 1 over 3.5 to 18 gigahertz frequency range was achieved. The length of this termination is approximately half the length of a conventional or prior art termination and, most importantly, the leading razor edge is eliminated.

Figure 3A:
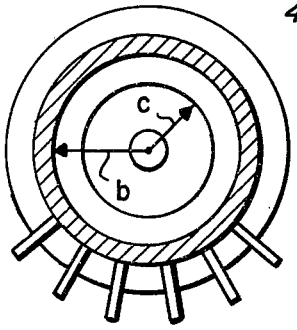
FIGS. 3A, 3B and 3C are views similar to FIG. 2 of another embodiment of an AC termination embodying the present invention.
Figure 3B:
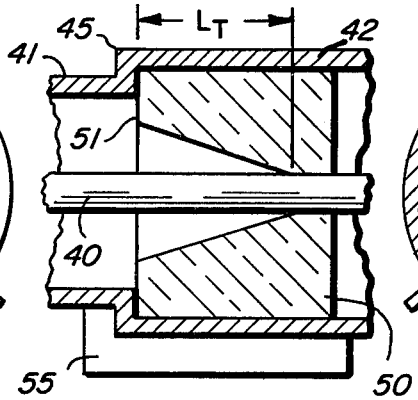
Figure 3C:
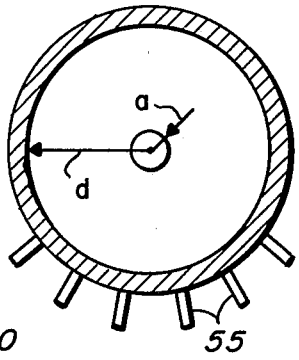

Referring to FIGS. 3A, 3B and 3C, a high power coaxial transmission line termination is illustrated in views similar to those described in conjunction with FIG. 2. In this embodiment an inner conductor 40 has a constant radius throughout the length thereof and the outer conductor is formed with a first portion 41 and a second portion 42. A step change in the radius of the outer conductor is indicated by the number 45. The portion 41 of the outer conductor has a radius which is indicated by the arrow b in FIG. 3A and, after the step change at 45, the radius of the portion 42 is indicated by the arrow d in FIG. 3C. Absorptive material 50 is positioned in the coaxial transmission line in engagement with the portion 42 of the outer conductor and is formed with a shoulder 51 at the leading edge thereof, which is positioned in abutting engagement with the step change 45 of the outer conductor. The inner radius of the shoulder 51 is indicated by the arrow c in FIG. 3A and is calculated utilizing the equation for c set forth above. The absorptive material 50 is tapered from the shoulder 51 inwardly into engagement with the inner conductor 40 and the length $L_T$ of the taper is calculated from the equation for $L_T$ set forth above. In this embodiment, the bulk of the absorptive material 50 is adjacent the outer conductor where fins 55, or some other form of cooling, can be provided to further increase the power handling capability of the termination.

Thus, an improved RF termination for use with a coaxial transmission line is disclosed wherein the leading razor edge is eliminated so that reproducibility is improved and fabrication is greatly simplified. Because of simplified fabrication and minimum rejection rate, the cost has been substantially reduced. Further, the terminations are substantially shorter and, therefore, the size of the overall structure has been reduced as well as reducing the amount of material therein. Also, an embodiment is illustrated which increases the power handling capabilities. In addition to the above percentages, the present invention improves the repeatability in manufacturing the termination and improves the electrical characteristics to provide superior performance over wider bandwidths.

While I have shown and described specific embodiments of this invention, further modifications and improvements will occur to those skilled in the art. I desire it to be understood, therefore, that this invention is not limited to the particular forms shown and I intend in the appended claims to cover all modifications which do not depart from the spirit and scope of this invention.

I claim:

1. An RF termination for use with a coaxial transmission line having an inner conductor and an outer conductor, said termination comprising absorptive material positioned in the coaxial transmission line between the inner and outer conductors, one of the inner and outer conductors having a step change in the radius thereof with said absorptive material commencing at the step change and increasing in amount to an area spaced longitudinally from said step change where the absorptive material extends from the inner to the outer conductor, and the amount of absorptive material at the step change being sufficient to provide a characteristic impedance at the step change which is substantially equal to the characteristic impedance of the coaxial transmission line prior to the step change.

2. An RF termination as claimed in claim 1 wherein the absorptive material extends from the conductor with the step change toward the other conductor to form a shoulder positioned in abutting engagement with the step change.

3. An RF termination as claimed in claim 2 wherein the absorptive material tapers from the shoulder to the area where the material extends from the inner to the outer conductor and the junction of the taper and the shoulder form an edge.

4. An RF termination as claimed in claim 3 wherein the edge has a radius defined by the equation $$C = d\,\mathrm{Log}_{10}{}^{1}\left[\left(\frac{\Sigma_R}{\Sigma_R - 1}\right)\mathrm{Log}_{10}\frac{b}{d}\left[1 - \frac{1}{\left(\frac{138}{Z_o}\mathrm{Log}_{10}\frac{b}{d}\right)^2}\right]\right]$$

where c is the radius of the edge, b is the radius of the outer conductor prior to the step change, d is the radius of the conductor, having the step change therein, after the step change, $\Sigma_R$ is the relative dielectric constant of the absorptive material, and $Z_o$ is the characteristic impedance of the coaxial transmission line prior to the step change.

5. An RF termination as claimed in claim 4 wherein the taper is substantially linear.

6. An RF termination as claimed in claim 5 wherein the axial length of the taper from the edge to the area where the material extends from the inner to the outer conductor is defined by the equation $$L_T = \frac{\lambda_{min/2}}{1 + \frac{1}{2}\left(\frac{\Sigma_R - 1}{\Sigma_R L_n \frac{b}{d}}\right)\left[2 + L_n\frac{c}{d} + \left(\frac{4}{\frac{b}{c} - 1}\right)\mathrm{Log}_{10}\left(\frac{2}{1 + \frac{b}{c}}\right)\right]}$$

where $L_T$ is the taper length, and $\lambda_{min}$ is the wavelength of the minimum frequency conveyed by the transmission line.

7. An RF termination as claimed in claim 5 wherein the step change is in the inner conductor with the radius thereof being substantially reduced throughout the length included between the step change and the area where the material extends from the inner to the outer conductors.

8. An RF termination as claimed in claim 5 wherein the step change is in the outer conductor with the radius thereof being substantially increased throughout the length included between the step change and the area where the material extends from the inner to the outer conductors.

9. An RF termination for use with a coaxial transmission line having an inner conductor and an outer conductor, said termination comprising absorptive material positioned in the coaxial transmission line between the inner and outer conductors, the inner conductor having a step reduction in the radius thereof with said absorptive material positioned in surrounding engagement therearound commencing at the step reduction with an outer radius sufficient to provide a characteristic impedance at the step reduction which is substantially equal to the characteristic impedance of the transmission line prior to the step reduction and tapering outwardly toward the outer conductor to an area where the absorptive material engages the outer conductor.

10. An RF termination for use with a coaxial transmission line having an inner conductor and an outer conductor, said termination comprising absorptive material positioned in the coaxial transmission line between the inner and outer conductors, the outer conductor having a step increase in the radius thereof with said absorptive material having a radially inwardly extending shoulder in abutting engagement with said step increase and said absorptive material tapering inwardly from said shoulder into engagement with the inner conductor, the inner radius of said absorptive material at said shoulder being sufficient to provide a characteristic impedance at the step increase which is substantially equal to the characteristic impedance of the transmission line prior to the step increase.

* * * * *